United States Patent [19]

Watkins

[11] 4,326,584

[45] Apr. 27, 1982

[54] KELLY PACKING AND STRIPPER SEAL PROTECTION ELEMENT

[75] Inventor: Bruce J. Watkins, Palos Verdes Estates, Calif.

[73] Assignee: Regan Offshore International, Inc., Torrance, Calif.

[21] Appl. No.: 174,946

[22] Filed: Aug. 4, 1980

[51] Int. Cl.[3] ..... E21B 17/10

[52] U.S. Cl. ..... 166/82; 166/84; 175/220

[58] Field of Search ..... 166/82, 84, 80, 177, 166/75 R; 175/7, 220; 308/4 A; 277/31, 38

[56] References Cited

U.S. PATENT DOCUMENTS

| | | | |
|---|---|---|---|
| 2,808,229 | 10/1957 | Bauer et al. | 166/82 |
| 2,927,774 | 3/1960 | Ormsby | 277/31 |
| 3,227,229 | 1/1966 | Wakefield, Jr. | 175/220 |
| 3,247,914 | 4/1966 | Slack | 175/7 |
| 3,561,723 | 5/1968 | Cugini | 277/31 |
| 3,791,442 | 2/1974 | Watkins | 166/355 |
| 3,965,987 | 6/1976 | Biffle | 166/84 |

*Primary Examiner*—James A. Leppink

*Attorney, Agent, or Firm*—Robert A. Felsman; Guy P. Smith

[57] ABSTRACT

A stripper seal protection and operating tool sealing element and method for protecting stripper seals during drilling operations with operating tools having both polygonal and circular cross sections. The stripper seal protection and operating tool sealing element includes a lower protective sleeve for expanding the stripper seal radially outward to prevent contact with polygonal operating tools and includes a head portion integral therewith for mounting an elastic sealing ring for packing off on the polygonal operating tool. The protective sealing element is particularly useful for applications in diverter housings of the rotating insert type. The protective and sealing element is inserted and removed from the diverter coupling concurrently with polygonal operating tools such as kellies. The protective sealing element also includes rotating lock means to provide common rotation of the rotating insert with the kelly. Further, means are provided for biasing the sealing ring laterally outward to insure adequate sealing between the kelly and element head portion.

20 Claims, 4 Drawing Figures

KELLY PACKING AND STRIPPER SEAL PROTECTION ELEMENT

BACKGROUND OF THE INVENTION

The present invention relates generally to subsea well apparatus for coupling a riser string to a floating vessel over a subsea well to which the string is run. More particularly, the invention relates to a diverter type coupling having a rotating insert with a bottom stripper rubber seal for sealing off on operating tools, such as kellies, drill pipes or tool joints inserted through the diverter coupling and into the riser string.

In general, diverter couplings are well known and a typical diverter coupling is disclosed in U.S. Pat. No. 3,791,442 issued to Watkins on Feb. 12, 1974. In addition, diverter couplings are also well known in which a rotating insert is provided for sealing to, and rotating in common with, the various operating tools inserted therethrough. Reference is made to pages 4262 and 4263 of the Regan Forge and Engineering Company section of the 1974–75 Composite Catalog.

A diverter with rotating insert typical of the above-mentioned well known couplings is shown in FIG. 4. Referring to FIG. 4, the diverter coupling is shown generally at 10. The diverter coupling 10 includes a lower housing 12 for receiving a suitable riser string (not shown). The lower housing 12 is provided with a diverter outlet 14 for diverting low pressure formation gas encountered in top hole drilling or any gas or liquid accumulation in the subsea riser system. An upper housing 16 receives the insert housing 18. The insert housing 18 is sealed within upper housing 16 by way of an annular packing ring 20. The packing ring 20 seals the insert housing 18 to the upper housing 16 to prevent the escape of pressurized gases and liquids. Within the insert housing 18 is journalled the rotating insert 22. As is the usual practice, the rotating insert 22 is mounted within the insert housing 18 on roller bearings 24 and is provided with seals 26 and 28 to prevent the escape of pressurized gases and liquids from between the insert housing 18 and rotating insert 22. A drill pipe 30 is shown as it would be used in a typical operation utilizing the diverter coupling 10. The lower end of the drill pipe extends downward through the riser string to the sea floor while the upper portion of the drill pipe extends to the rotary operating table on the drilling platform.

An important aspect of diverter couplings is to provide a suitable seal around the drill pipe 30 during drilling operations and while the drill pipe is being raised or lowered. In order to seal off the drill pipe 30 to prevent escape of pressurized gases upwardly through the diverter coupling, a stripper seal 32 is commonly used. The stripper seal is an annular resilient rubber boot which is mounted fixedly on the rotating insert 22. It is designed to expand and contact within certain limits to seal off on the drill pipe and other operating tools to force pressurized gases out through the diverter outlet 14 rather than allowing them to escape up through the rotating insert 22.

The sealing characteristics of stripper seals when used with operating tools such as drill pipes having circular cross sections only, has proved adequate in the past for most drilling operations. However, problems have been experienced with providing adequate sealing with the stripper seal when it is used for sealing not only drill pipes, but when the stripper seal is also used to seal off operating tools having polygonal cross sections, such as kellies. When a stripper seal having an essentially circular opening is used to seal off a hexagon or square kelly, the sealing action of the stripper seal is not uniform, thereby increasing the likelihood of gas leakage, especially when high pressure gas accumulations are encountered. Further, the hexagon or square kelly tends to deform the usually circular inner sealing surface of the stripper seal to render it less effective in sealing off a circular drill pipe which is subsequently inserted into the diverter coupling. Since in many drilling operations, drill pipes and kellies are lowered and raised through the diverter coupling repeatedly, the stripper seal becomes deformed to prevent adequate sealing around the circular drill pipe, while at the same time providing a less than optimum seal around the non-circular kelly.

It is therefore desirable to provide a suitable means for protecting the stripper seal from contacting polygonally cross sectioned operating tools, such as kellies, during drilling operations. It is further desirable that while the stripper seal is being protected from contacting the kelly, that an alternative and more suitable means be provided for sealing the kelly to the rotating insert to prevent escape of gases or fluids from the diverter coupling.

SUMMARY OF THE INVENTION

A primary object of the present invention, is therefore, to disclose and provide a means for providing adequate sealing to operating tools where operating tools having circular and polygonal cross sections are utilized in the drilling operation.

It is another object of the present invention to disclose and provide a method and apparatus for preventing the stripper seal from contacting a polygonally cross sectioned operating tool such as a kelly while at the same time providing an alternative means for sealing the kelly to the rotating insert which is in turn sealed within the diverter coupling housing.

A further object of the present invention is to disclose and provide a method and apparatus for protecting the stripper seal from contacting kelly-type operating tools by expanding the stripper seal radially outward.

It is also an object of the present invention to disclose and provide a means for protecting the stripper seal and packing off on the kelly which is insertable within the diverter coupling and removable therefrom in common with the kelly.

In general, the above objects are accomplished by a stripper seal protection and operating tool sealing element in accordance with the present invention. The stripper seal protection and operating tool sealing element of the present invention includes a lower tubular portion and an upper head portion integral therewith. The element is placed concentrically about a polygonal operating tool and inserted through the rotating insert into contact with the stripper seal thereby expanding the stripper seal radially outward and providing a protective surface between the stripper seal and the polygonal operating tool. The upper head portion is adapted to receive an elastomeric sealing member held between upper and lower opposed end rings and having an inner surface for sealing contact with the polygonal operating tool and an outer surface for sealing contact with the head portion inner surface. Insertion of the stripper seal protection and operating tool sealing element along with the polygonal operating tool expands the stripper seal to prevent contact with the operating tool while at the same time providing a suitable seal between the operating tools and the rotating insert.

Further, the present invention includes rotation lock means associated with the head portion to effectively rotatably lock the insert housing to the kelly to provide common rotation of the kelly and rotating insert. In addition, the present invention includes provision for preventing removal of the kelly from the insert coupling without concurrently removing the stripper seal protection and operating tool sealing element. Further, an insertion biasing ring is included for transferring downward force exerted against kelly to the lower tubular protective sleeve in an amount sufficient to expand the stripper seal.

The stripper seal protection and operating tool seal element of the present invention is particularly useful in drilling operations where high pressures may be encountered since a more adequate seal is provided on the polygonal operating tools by the elastomeric sealing member than possible with the non-uniformly stretched stripper seal sealing. At the same time, the element of the present invention protects the stripper seal for continued sealing to drill pipes and other circular operating tools.

These and many other features and inherent advantages of the present invention will become apparent as the invention becomes better understood by reference to the following detailed description when considered in conjunction with the accompanying drawings.

DETAILED DESCRIPTION OF THE PRESENT INVENTION

Figure 1:
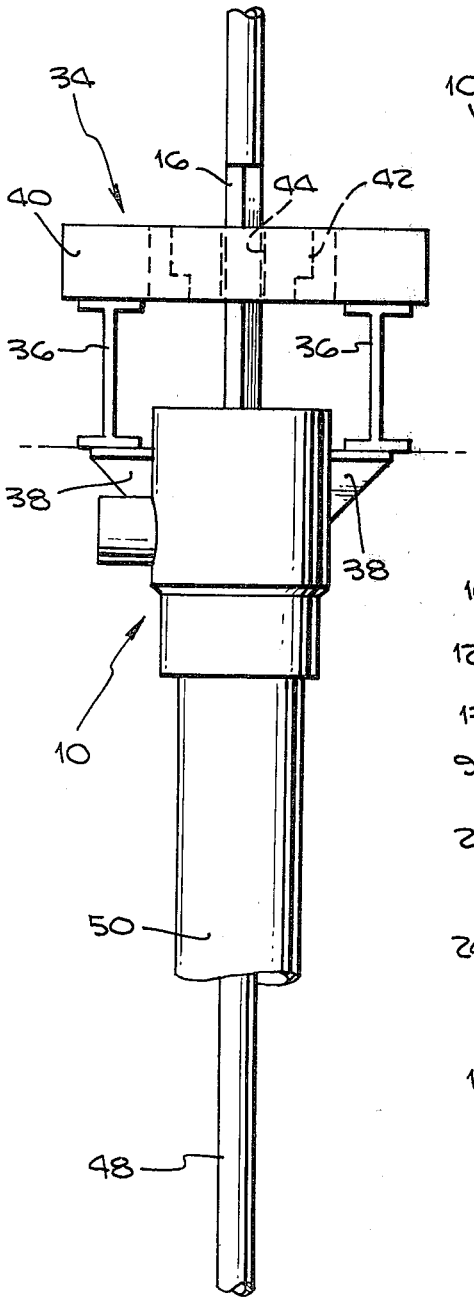
FIG. 1 is a side view of a diverter coupling in place under a rotating table structure.

Referring first to FIG. 1, a rotating table structure is shown generally at 34. The rotating table structure 34 has I-beams 36 attached on the bottom for supporting the diverter coupling 10. The diverter coupling 10 has mounting members 38 which are bolted to or otherwise securely attached to the I-beams 36 to suspend the diverter coupling 10 in place under the rotating table structure 34. The rotating table structure 34 includes a stationary platform 40 which has a large hole therein for receiving and rotatably driving a rotating element 42. The rotating element 42 includes a square hole 44 which receives a square kelly 46 and mates with the square kelly 46. By rotating the rotating element 42, rotational torque is thereby applied to the square kelly 46 and connected drill pipes such as drill pipe 48 extending down the riser string 50.

Figure 2:
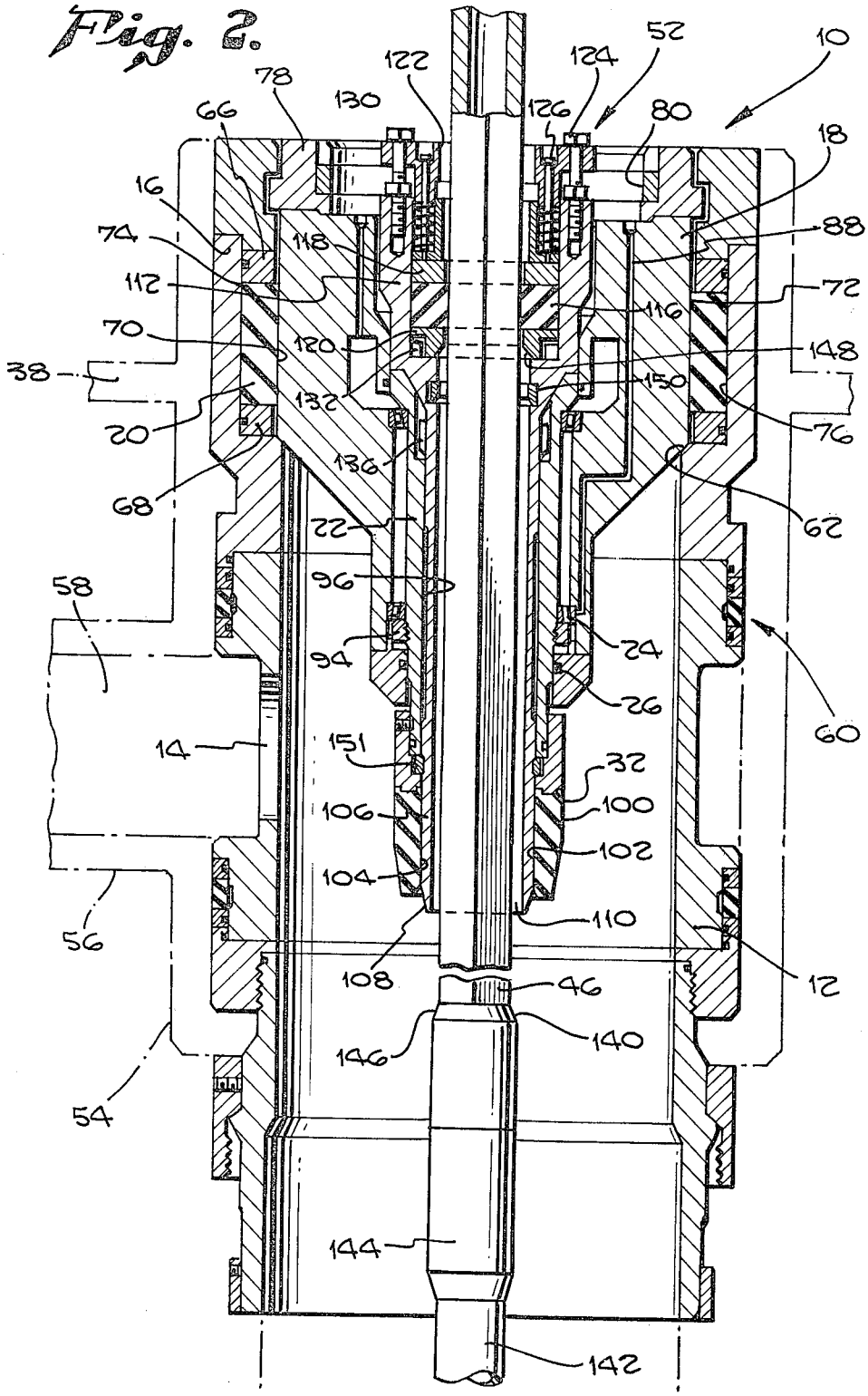
FIG. 2 is a cross sectional view of a preferred exemplary embodiment of the present invention in place within a preferred rotating insert type diverter coupling.

Now referring to FIG. 2, the diverter coupling 10 is shown with the stripper seal protection and operating tool sealing element of the present invention shown in place generally at 52. Before describing the preferred element 52 of the present invention and its operation in detail, the following will be a description of the preferred diverter coupling in which the present invention is utilized.

Figure 4:
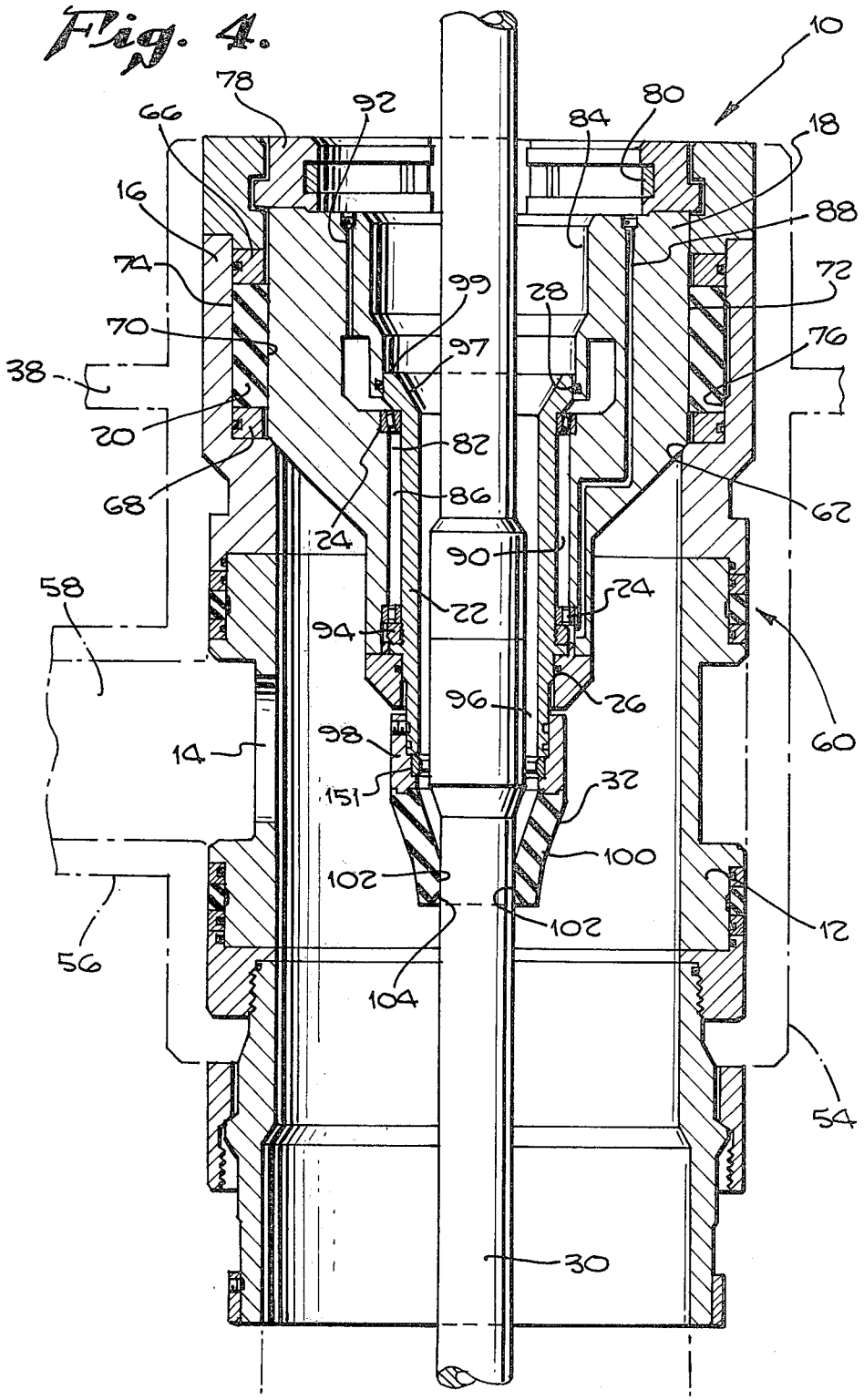
FIG. 4 is a cross sectional view of a typical rotating insert type diverter coupling known in the art.

The diverter coupling shown generally at 10 in FIG. 2 is the same diverter coupling as that shown at 10 in FIG. 4 except for the insertion of the preferred element 52 of the present invention and a square kelly 46 as opposed to FIG. 4 which does not include the preferred element 52 of the present invention and shows a circular drill pipe 30 extending through the coupling 10. Therefore, the following description regarding the diverter coupling applies equally to both FIGURES.

The diverter coupling shown generally at 10 is of the rotating insert type. It includes an outer shell 54 for enclosing the entire diverter mechanism. The shell 54 includes the mounting members 38 for attaching to the rotating table structure 34 and further includes diverter conduit 56 defining diverter shell opening 58 for allowing the diversion and removal of pressurized gases and fluids present in the riser string 50 during drilling operation.

As described in the background of the invention, a lower housing 12 is provided within the outer shell 54 for coupling to the riser string 50 extending from the ocean floor. The lower housing 12 also includes diverter outlet 14 in line with diverter shell opening 58 for diversion and removal of pressurized gases and fluid. The lower housing 12 is connected to and made integral with an upper housing 16 by suitable sealed connections such as those shown generally at 60. The upper housing 16 includes a seating surface 62 which provides a stop against which insert housing 18 is lowered against. The upper housing 16 is adapted to receive an annular packing ring 20. The packing ring 20 is of the type well known in the art including a central elastomeric ring 64 which is sandwiched between an upper metallic ring 66 and a lower metallic ring 68. The elastomeric ring has an inner surface 70 for sealing to the insert housing outer surface 72. Likewise, the elastomeric ring has an outer surface 74 for sealing to the inner surface 76 of upper housing 16 to provide an effective seal between the insert housing 18 and the upper housing 16.

The insert housing 18 is held in place within upper housing 16 by lock ring 78. Lock ring 78 is of the split ring type which is inserted in separate pieces to the position shown in FIG. 2 and locked in place by lock ring 80. The insert housing 18 has an axial opening 82 passing through it for receiving the rotating insert 22. The axial opening 82 includes an upper wider portion 84 and a lower narrower portion 86. The rotating insert 22 is rotatably journalled mainly within the narrower opening 86. Bearings 24 are provided for rotatably mounting the rotating insert 22 within the insert housing 18. Grease or other lubricating oil is introduced through line 88 and into lubrication chamber 90 to supply adequate lubricant to the bearings 24. Air and excess lubricant are vented and removed from lubrication chamber 90 through line 92. A support ring 94 is also provided for supporting the lower bearings.

Figure 3:
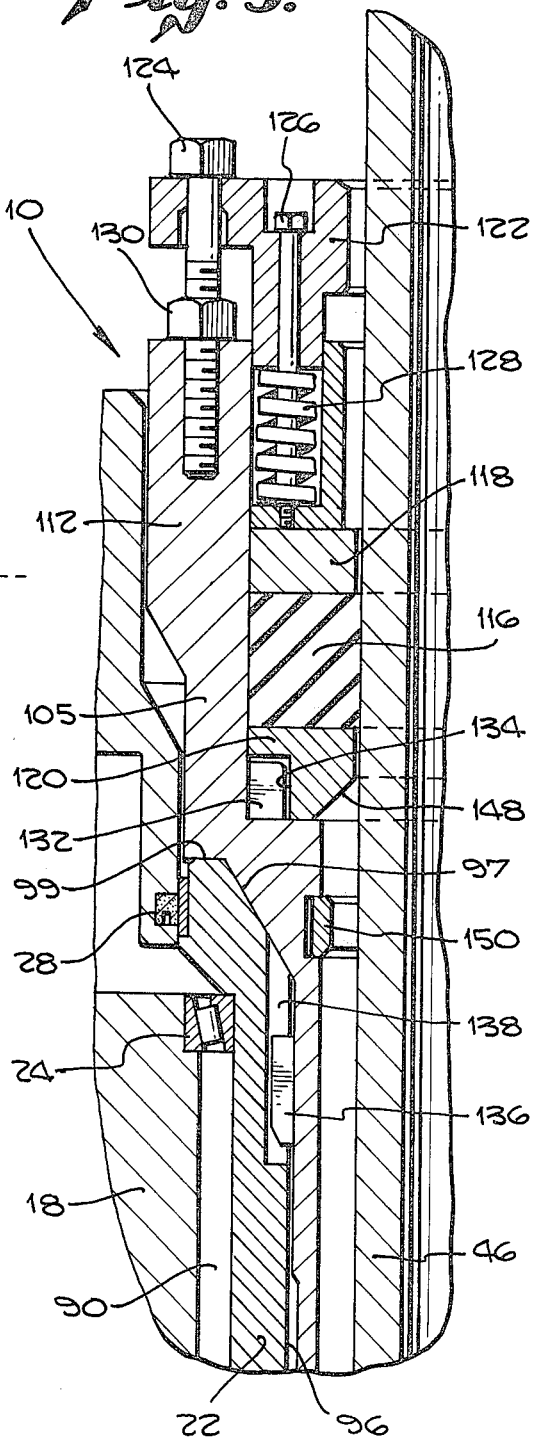
FIG. 3 is a detailed cross sectional view of the upper lefthand corner of FIG. 2.

The rotating insert 22 is tubular in shape having an axial opening 96. The rotating 22 insert also includes surfaces 97 and 99 (as best shown in FIG. 3) against which element 52 is seated and positioned during use. In general, the axial opening 96 is sufficiently large to allow passage of operating tools including drill pipes and kellies and required connectors therethrough. In addition, the rotating insert is usually keyed in some manner to rotatably lock it to the operating tool to provide common rotation of the rotating insert with the operating tool. Sealing rings 26 and 28, as previously mentioned, are provided to seal the rotating insert 22 within the insert housing 18 to prevent the escape of lubricant from the lubricating chamber 90 and also to prevent escape of gases and fluids through the top of the coupling from the riser string.

On the lower end of the rotating insert 22 is mounted the stripper seal 32. The stripper seal 32 includes a rigid annular portion 98 which is securely attached to the bottom of the rotating insert 22. Attached to the rigid annular portion 98 is a resilient annular boot 100. The resilient annular boot 100 has an inner surface 102 which seals against the various operating tools lowered through the axial opening 96 of the rotating insert 22. The inner surface 102 is circular in shape defining a circular stripper seal opening 104. As operating tools are lowered into and removed from the diverter coupling 10, the annular resilient boot 100 expands and contracts to maintain a seal about the operating tool. Since the opening 104 is circular in shape, the annular boot 100 seals best around circular operating tools, while it seals less optimumly around polygonal operating tools. Having described the preferred rotating insert diverter coupling for use with the present invention, the following will be a detailed description of the preferred stripper seal protection and operating tool sealing element of the present invention.

As shown in FIG. 2, the preferred stripper seal protection and operating tool sealing element of the present invention is shown generally at 52. In accordance with the present invention, stripper protection means for expanding the annular boot 100 radially outward are provided by a protective sleeve member 105 which includes a tubular portion 106. The tubular portion 106 has a tapered end 108 for initially contacting the annular boot 100 when the tubular portion 106 is inserted into contact with the annular boot 100. The tubular portion 106 defines an inner opening 110 which is of sufficient size to allow passage of square kelly 46 therethrough.

The stripper seal protection and operating tool sealing element of the present invention further includes packing means such as those provided by head portion 112 of the protective sleeve member 105. In the preferred element 52, the lower tubular portion and protective sleeve 106 and the head portion 112 are integrally formed and comprise a single insertable element.

The head portion 112 has an inner surface 114 which is adapted to receive an elastomeric sealing member such as sealing ring 116 which is sandwiched between upper and lower opposed end rings 118 and 120 respectively. The inner surfaces of the sealing ring 116 and the opposed end ring 118 and 120 define a square orifice which matingly engages with kelly 46. A bias ring 122 is located above the upper end ring 118 and includes adjustment bolts 124. Tightening of the adjustment bolts 124 causes a downwardly bias to be transferred to the upper end ring 118 by way of biasing ring 122. The downward bias placed on end ring 118 causes the elastic sealing ring 116 to be biased laterally outward in both directions against the kelly 46 and inner surface 114 of head portion 112. By tightening adjustment bolts 124, the desired amount of sealing pressure may be exerted by the sealing ring 116. Alignment bolts 126 are provided for aligning biasing ring 122 over bias springs 128. The downward adjustment of bias ring 122 by way of adjustment bolts 124 increases tension on and compresses bias springs 128 which in turn exerts bias on the sealing ring 116. Lock nuts 130 are provided on adjustment bolts 124 to lock the adjustment bolts 124 in their desired adjusted position.

The element 52 further includes rotation lock means to couple the kelly 46 with the rotating insert 22 to provide common rotation of the kelly 46 and rotating insert 22. The rotation lock means includes inner tabs 132 which lock into tab receiving grooves 134 in the lower end ring 120. The engagement of inner tabs 132 with tab receiving grooves 134 rotatably locks the element 52 to the opposed end ring 120 which is matingly engaged with the kelly 46. Further, outer tabs 136 are received in outer tab receiving grooves 138 to rotatably lock the element 52 to the insert housing 22. The above-described configuration of tabs and grooves thereby effectively rotatably locks the kelly 46 to the rotating insert 22 to provide common rotation. Having described the preferred stripper seal protection and operating tools sealing element 52 of the present invention, the following will be a detailed description of use and operation of the element 52 in conjunction with the preferred rotating insert type diverter 10.

FIG. 2 shows the preferred element 52 of the present invention in position during typical drilling operations. The kelly 46 passes completely through the rotating insert 22 and is connected at its lower portion 140 to an operating tool such as drill pipe 142 by a suitable connector 144. Although the kelly is shown as a square kelly, it will be realized that hexagonal, octagonal and other kellies or operating tools having generally polygonal cross sections may also be used. When referring to operating tools having polygonal cross sections, it is intended that this term cover all of the various non-circular operating drills with regular and irregular polygon cross sections exclusive of circular cross sections, such as those found in drill pipes. During oil well operations such as drilling, the kelly 46 and drill pipe 142 will continually move downward relative the rotating insert as the drilling progresses. During the operation as shown in FIG. 2, the annular boot 100 is maintained in the expanded position and out of contact with the kelly 46. Likewise, the sealing ring 116 seals off the kelly 46 to replace the seal which is lost during protection of the annular boot 100. The annular boot 100 is sealed to the outer surface of the tubular portion 106 thereby preventing escape of gas or fluid from between the rotating insert 22 and element 52.

As the kelly 46 and drill pipe 142 move lower towards the well bore, at some point the kelly 46 and drill pipe 142 will have to be pulled upward to the rotating table structure 34 to add additional drill pipes to increase the length of the drill string. As the kelly 46 is moved upward through the element 52, the sloping surface 146 on the kelly lower portion 140 abuts against and is stopped by the stop surface 148 on lower end ring 120. As the kelly 46 is continually pulled upward, the element 52 is also pulled upward along with the kelly 46 out of its insertion within the insert housing 18 and rotating insert 22. As the element 52 is being pulled upward by kelly 46, the tubular portion 106 of element 52 is pulled upward and away from annular boot 100 thereby allowing the annular boot 100 to return to its unexpanded position sealing around drill pipe 142.

After a suitable new drill pipe has been added to the drill string or other operations carried out, the kelly 46, with the element 42 concentrically located thereon, is again passed down into the insert housing 18 and rotating insert 22. On the inner surface of head portion 112 and located below stop surface 148 is a biasing ring 150.

The biasing ring is resilient annular ring designed to engage and releasably seal to the kelly lower portion 140 as sloping surface 146 contacts stop surface 148. As the kelly and element 52 are lowered into the rotating insert 22, the tapered end 108 of tubular portion 106 contacts the contracted annular boot 100. The biasing ring 150 releasably secures the element 52 to the downward moving kelly 46 to exert sufficient downward force on tubular portion 106 to expand the annular boot 100 radially outward. The biasing ring 150 remains sealed to the kelly lower portion 140 until the sealing element 52 is seated upon the rotating insert 22 whereupon the resilient grip or seal of the biasing ring 150 on the lower portion 140 is broken and the kelly 46 continues down through the insert housing while element 52 remains seated in place. Snap ring 151 is also provided to hold the element 52 in place until the element 52 is forced upwardly out by the kelly lower portion 140.

Since it is contemplated that the annular boot 100 may be kept in an expanded condition by tubular portion 106 for extended periods of time, tests were conducted to determine if a typical rubber boot would return to its unexpanded dimensions after prolonged expansion. The tests were conducted on a four inch internal diameter molded rotating element stripper (Part No. 32984-B, Compound No. B110,1).

Three separate tests were conducted in which the rubber stripper was expanded to 7-$\frac{3}{4}$ inches internal diameter for a period of 24 hours, 96 hours and eight days. After each test the rubber stripper was released and measured. After 24 hours, the internal diameter returned to 4-$\frac{1}{2}$ inches and two days later measured 4-$\frac{1}{4}$ inches internal diameter. For the rubber stripper held expanded for 96 hours, upon release the internal diameter measured 4-$\frac{5}{8}$ inches, while one day later it measured 4-$\frac{1}{4}$ inches internal diameter. Finally, the rubber stripper which was held expanded for eight days measured an internal diameter of 4-13/16 inches after release and one day later measured 4-7/16 inches. Additionally, two days later the internal diameter had dropped to 4-$\frac{3}{8}$ inches. In none of the tests did the rubber stripper appear to be damaged.

Having thus described the exemplary embodiment of the present invention, it should be noted by those skilled in the art that the within disclosures are exemplary only and that various other alternatives, adaptations and modifications may be made within the scope of the present invention. Thus, by way of example and not of limitation, the stripper seal protection and operating tool sealing element of the present invention could equally as well be applied to various other riser couplings wherein it is desired to prevent the stripper seal from contacting kellies while at the same time providing a suitable seal for packing off on the kelly. Accordingly, the present invention is not limited to the specific embodiment as illustrated herein.

What is claimed is:

1. A stripper seal protection and operating tool sealing element adapted to protect a resilient annular stripper seal from contacting polygonally cross sectioned operating tools passing axially therethrough while maintaining a seal between the polygonal operating tool and the rotating insert of a diverter riser coupling, said element comprising:

stripper protection means for expanding radially outward said stripper seal to prevent said stripper seal from contacting said polygonal operating tool; and packing means for providing said seal between the polygonal operating tool and the rotating insert when said stripper seal is prevented from contacting said polygonal operating tool.

2. An element according to claim 1 wherein said protective means include a protective sleeve member having a tubular portion selectively insertable concentrically between said polygonal operating tool and said stripper seal whereby said stripper seal is expanded radially outward and prevented from contacting said polygonal operating tool.

3. An element according to claim 2 wherein said packing means includes a head portion of said protective sleeve member integral with said tubular portion having an inner surface adapted for receiving an elastomeric sealing member held between upper and lower opposed end rings and having an inner surface for sealing contact with said polygonal operating tool and an outer surface for sealing contact with said head portion inner surface and further including means for biasing said end rings towards each other to bias said elastomeric sealing member laterally outward towards said polygonal operating tool and said head portion inner surface.

4. An element according to claim 3 further including rotation lock means associated with said head portion for providing common rotation of said operating tool, protective sleeve member and said rotating insert.

5. An element according to claim 3 wherein said rotation lock means includes providing at least one of said end rings with an inner surface for matingly engaging said polygonal operating tool and an outer surface having tab receiving means for receiving tab means associated with said head portion inner surface to prevent rotation of said end ring relative said head portion, said rotation lock means further including means for engaging said element with said rotating insert to provide common rotation only therewith.

6. An element according to claim 5 further including removal means for removing said element from said diverter riser coupling in response to removal of said polygonal operating tool from said diverter riser coupling.

7. An element according to claim 6 wherein said removal means includes stop means associated with said element head portion for engaging the lower end of a polygonal operating tool as the tool is upwardly removed from said diverter riser coupling whereby common removal of said polygonal operating tool and said element is provided.

8. An element according to claim 7 wherein said stop means includes a stop surface on the bottom of said lower end ring for engaging a radially protruding surface on the lower end of said polygonal operating tool.

9. An element according to claim 8 further including an insertion biasing ring located below said stop surface for biasingly engaging said radially protruding surface when said polygonal operating tool and element are lowered into said diverter riser coupling to bias said tubular portion against and expand said stripper seal.

10. An element according to claim 9 wherein said biasing ring is released from biasing engagement with said radially protruding surface only upon application of an amount of force on said element in a downward direction to expand said stripper seal to prevent said stripper seal from contacting said polygonal operating tool.

11. In a diverter riser coupling having a diverter housing with a lower portion for receiving a riser string, a diverter outlet and an upper portion for sealingly receiving an insert housing, said insert housing having a rotating insert sealingly journaled axially therein and rotatable relative said insert housing, said rotating insert having an inner surface defining an axial insert bore for allowing passage of operating tools therethrough, said rotating insert including a lower portion extending externally of said insert housing and having an annular resilient stripper seal mounted thereon, said stripper seal having an inner sealing surface defining a sealing orifice for sealing around operating tools having circular and polygonal cross sections passing therethrough to provide a seal between said operating string and said rotating insert, said rotating insert further including means for engaging said rotating insert with said operating tools to provide common rotation therewith, wherein the improvement comprises:

stripper protection means for selectively preventing said stripper seal from contacting said operating string when a polygonal operating tool is passed through said sealing orifice; and means for providing a seal between said polygonal operating tool and said rotating insert when said stripper seal is prevented from contacting said polygonal operating tool.

12. An improvement in a diverter riser coupling according to claim 11 wherein said stripper protection means includes a protective sleeve member having a tubular portion selectively insertable axially between said sealing orifice and said operating tool whereby a seal between said stripper seal and said protective sleeve member is provided and said stripper seal is prevented from contacting said operating tool.

13. An improvement in a diverter riser coupling according to claim 12 wherein said protective sleeve member further includes a head portion integral with said tubular portion adapted for receiving packing means for providing a seal between said polygonal operating riser and said protective sleeve member.

14. In a diverter riser coupling having a diverter housing with a lower portion for receiving a riser string, a diverter outlet and an upper portion for sealingly receiving an insert housing, said insert housing having a rotating insert sealingly journaled axially therein and rotatable relative said insert housing, said rotating insert having an inner surface defining an axial insert bore for allowing passage of operating tools therethrough, said rotating insert including a lower portion extending externally of said insert housing and having an annular resilient stripper seal mounted thereon, said stripper seal having an inner sealing surface defining a sealing orifice for sealing around operating tools having circular and polygonal cross sections passing therethrough to provide a seal between said operating string and said rotating insert, said rotating insert further including means for engaging said rotating insert with said operating tools to provide common rotation therewith, wherein the improvement includes an operating tool packing and stripper seal protection element comprising:

a protective sleeve member having a lower tubular portion with an inner surface defining an axial sleeve bore for allowing passage of said operating tools therethrough and an outer cylindrical surface for expanding said stripper seal radially outward and sealing to said inner sealing surface, said protective sleeve member further including an upper head portion integral with said lower tubular portion and having an outer surface and an inner surface;

packing means for providing a seal between said operating tool and the head portion inner surface.

15. An improvement in a diverter riser coupling according to claim 14 including rotation lock means associated with said protective sleeve member for providing common rotation of said operating tool, protective sleeve member and said rotating insert.

16. An improvement in a diverter riser coupling according to claim 15 wherein said packing means includes an annular elastomeric sealing member held between upper and lower opposed end rings and having an inner surface for sealing contact with said operating tool and an outer surface for sealing contact with said head portion inner surface.

17. An improvement in a diverter riser coupling according to claim 16 further including means for biasing said end rings towards each other to bias said elastomeric sealing member laterally outward towards said operating tool and said head portion inner surface.

18. An improvement in a diverter riser coupling according to claim 17 including means for inserting said protective sleeve member concentrically within said insert bore and insert housing to a protective position where said stripper seal is expanded and protected from said operating tool and said elastomeric sealing member is in sealing contact with said operating tool and said head portion inner surface.

19. An improvement in a diverter riser coupling according to claim 18 including means for removing said protective sleeve member from said protective position.

20. A kelly packing and stripper seal protection element adapted for selective axial insertion into a rotating insert sealably journaled within a diverter riser coupling to prevent the kelly from contacting the stripper seal comprising:

a lower tubular portion for insertion concentrically about said kelly to sealingly expand said stripper seal and prevent said kelly from contact therewith;

an upper head portion integral with said lower tubular portion and including packing means for providing a seal between said kelly and said protection element.

* * * * *